US009514630B1

(12) United States Patent
Steven

(10) Patent No.: US 9,514,630 B1
(45) Date of Patent: Dec. 6, 2016

(54) SYSTEM AND METHOD FOR TRACKING PHYSICAL LOCATION OF VEHICLE KEYS

(71) Applicant: Brandon Steven, Wichita, KS (US)

(72) Inventor: Brandon Steven, Wichita, KS (US)

( * ) Notice: Subject to any disclaimer, the term of this patent is extended or adjusted under 35 U.S.C. 154(b) by 0 days.

(21) Appl. No.: 14/711,204

(22) Filed: May 13, 2015

(51) Int. Cl.
*G08B 1/08* (2006.01)
*G08B 21/24* (2006.01)

(52) U.S. Cl.
CPC ..... *G08B 21/24* (2013.01)

(58) Field of Classification Search
CPC ..... G06Q 10/06; G06Q 30/02; G07C 2009/00936; G07C 9/00103; G07C 9/00896; H04L 63/061; H04W 4/023; G08B 21/24
See application file for complete search history.

(56) References Cited

U.S. PATENT DOCUMENTS 8,726,556 B1 * 5/2014 Willingham ..... G08B 21/0261 42/1.01
2003/0060212 A1 * 3/2003 Thomas ..... H04W 4/02 455/456.1
2006/0212398 A1 * 9/2006 Seliber ..... G06Q 10/00 705/50
2010/0265131 A1 * 10/2010 Fabius ..... G01S 19/16 342/357.54
2013/0182382 A1 * 7/2013 Vardi ..... G08B 13/1463 361/679.01
2015/0371470 A1 * 12/2015 Brown ..... G07C 9/00896 340/5.61

OTHER PUBLICATIONS

Retrievor, website, http://www.retrievor.com/small-and-light-weight-gps-tracking, printed Apr. 21, 2016, 2 pages.
The TrackR, website, http://www.thetrackr.com/wallet, printed Apr. 21, 2016, 8 pages.
The Tile App, website, https://www.thetileapp.com/, printed Apr. 21, 2016, 4 pages.
Pet Tracker, website, http://www.pettracker.com/pet-gps/tagg-tracker-specs, printed Apr. 21, 2016, 3 pages.
Whistle, website, http://www.whistle.com/gps/, printed Apr. 21, 2016 7 pages.
The Protag, website, http://theprotag.com/, printed Apr. 21, 2016, 5 pages.

* cited by examiner

*Primary Examiner* — Ojiako Nwugo
(74) *Attorney, Agent, or Firm* — Armstrong Teasdale LLP

(57) ABSTRACT

A vehicle key monitoring system using a keychain device is provided. The system comprises a location database and a vehicle key monitor (VKM) device, which comprises a processor and memory and is connected to the location database. The VKM receives, from a location transmitter, a keychain location identifier and stores it in the location database. The VKM compares the location identifier to a plurality of location identifiers comprising an authorized zone for the keychain. The VKM transmits the current location to a client operated by a vehicle owner. The VKM determines that the keychain device location does not match the plurality of location identifiers for the authorized zone. The VKM generates an alert indicating that the keychain device is outside its authorized location zone. The VKM transmits the alert to the client, causing the client to display the alert and the current location of the keychain.

20 Claims, 10 Drawing Sheets

FIG. 5A
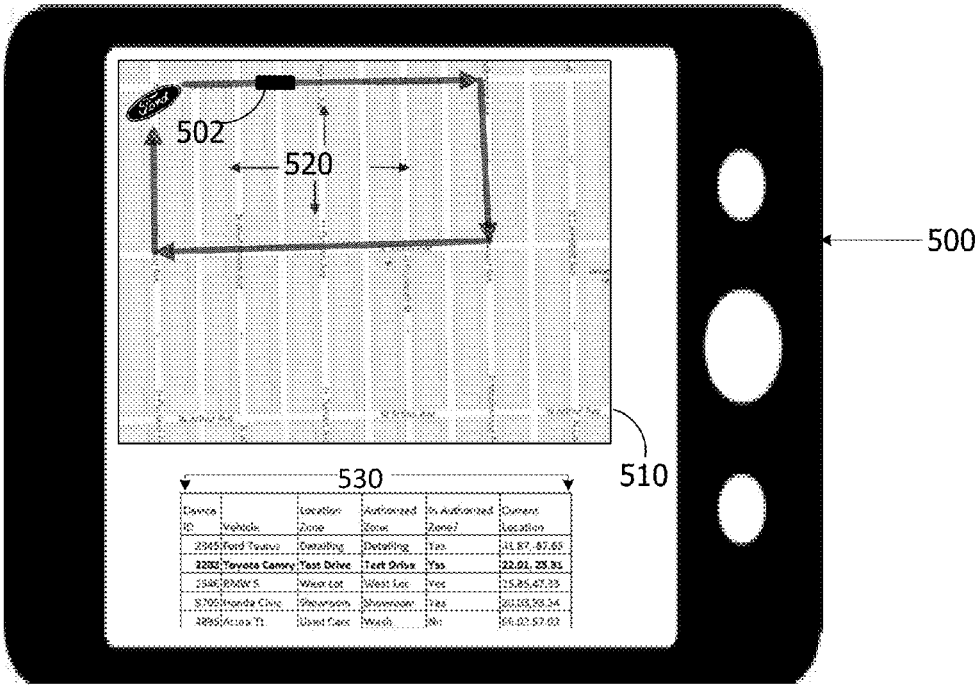
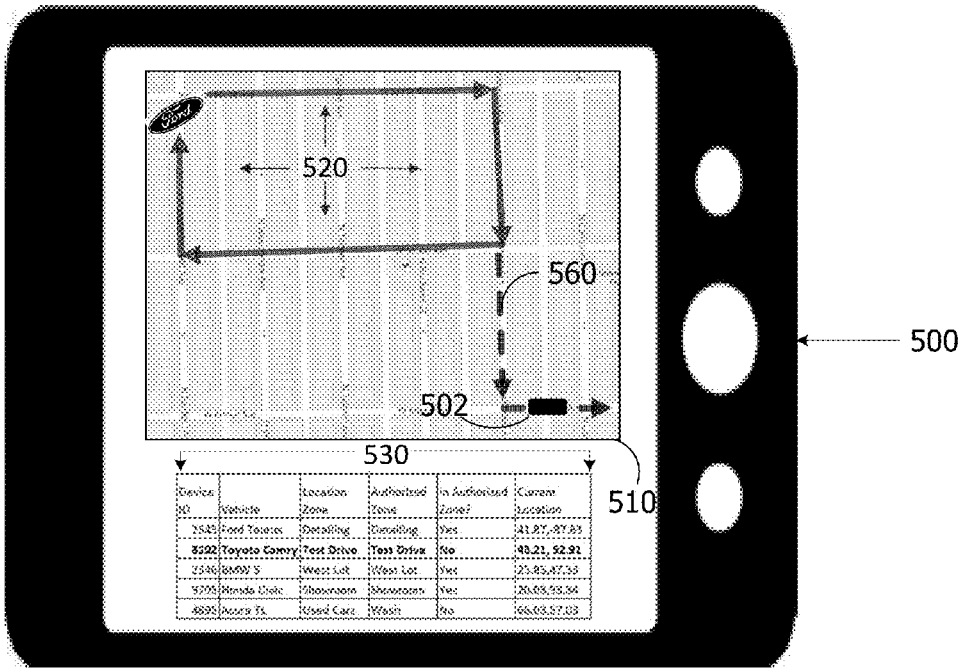
FIG. 5B

SYSTEM AND METHOD FOR TRACKING PHYSICAL LOCATION OF VEHICLE KEYS

BACKGROUND OF THE DISCLOSURE

This disclosure relates to tracking and management of vehicle keys and, more specifically, to monitoring the location of vehicle keys using an attached keychain device. Entities with control of large numbers of vehicles, e.g., car dealerships, may have difficulty keeping track of the corresponding large number of vehicle keys. Vehicle keys, a small and easily misplaced item, may change hands several times a day at a car dealership, leading to a significant risk of misplacement and loss. Key cabinets, frequently used by dealerships to inventory and track keys, are a single point of failure whenever keys are misplaced. In other words, if vehicle keys are believed to be misplaced and are not found in the key cabinet, they are effectively lost.

Also, dealership vehicles taken on test drives may or may not have onboard tracking systems, and require a salesperson to accompany the test driver to ensure the safe return of the vehicle. Unscrupulous individuals may copy vehicle keys while on a test drive and later steal the vehicle using the copy. Similarly, vehicle owners frequently lose track of their keys and are unable to use their vehicles until a physical search for the keys is successful, or until the owner purchases a replacement set. Moreover, vehicle owners have difficulty keeping track of their keys in the event that thieves or even the owners' driving-age children take the keys without authorization.

Known methods often are limited to tracking objects in a particular setting, e.g., over only short distances. Known methods include attaching keychain devices whose location is tracked using crowdsourcing methods. Unfortunately, many such methods rely on network effects (i.e. a product or service becomes more useful the more people use it). Therefore these are ineffective for users such as car dealerships who have finite resources and users and cannot wait to rely on a system to secure their vehicles and keys until sufficient numbers of people use the system.

BRIEF DESCRIPTION OF THE DISCLOSURE

In one aspect, a system for tracking and monitoring a physical location of keys for a vehicle using a keychain device attached to the keys is provided. The system comprises a location database and a vehicle key monitoring (VKM) computer device. The VKM computer device comprises a processor and a memory and is configured to be coupled to the location database. The VKM computer device is configured to receive, from a location transmitter device, a current location of the keychain device, including a first location identifier. The VKM computer device is also configured to store the current location of the keychain device in the location database. The VKM computer device is further configured to compare the first location identifier to one or more of a plurality of location identifiers for the keychain device, wherein the plurality of location identifiers comprises an authorized location zone for the keychain device. The VKM computer device is also configured to transmit the current location to a client computer device operated by a vehicle owner. The VKM computer device is further configured to determine that the location of the keychain device does not match one or more of the plurality of location identifiers for the keychain device. The VKM computer device is also configured to generate an alert indicating that the keychain device is not physically within the authorized location zone for the keychain device. The VKM computer device is further configured to transmit the alert to the client computer device, causing the client computer device to update a display with the alert and the current location of the keychain device.

In another aspect, a method of tracking and monitoring a physical location of keys for a vehicle using a keychain device attached to the keys is provided. The method is implemented using a vehicle key monitoring (VKM) computer device comprising a processor and a memory and configured to be coupled to a location database. The method includes the step of receiving, from a location transmitter device, a current location of the keychain device, including a first location identifier. The method also includes the step of storing the current location of the keychain device in the location database. The method further includes the step of comparing the first location identifier to one or more of a plurality of location identifiers for the keychain device, wherein the plurality of location identifiers comprises an authorized location zone for the keychain device. The method also includes the step of transmitting the current location to a client computer device operated by a vehicle owner. The method further includes the step of determining that the location of the keychain device does not match one or more of the plurality of location identifiers for the keychain device. The method also includes the step of generating an alert indicating that the keychain device is not physically within the authorized location zone for the keychain device. The method further includes the step of transmitting the alert to the client computer device, causing the client computer device to update a display with the alert and the current location of the keychain device.

In yet another aspect, a non-transitory computer-readable medium that includes computer executable instructions for tracking and monitoring a physical location of keys for a vehicle using a keychain device attached to the keys is provided. When executed by a vehicle key monitoring (VKM) computer device coupled to a location database, the computer-executable instructions cause the VKM computer device to receive, from a location transmitter device, a current location of the keychain device, including a first location identifier. The computer-executable instructions also cause the VKM computer device to store the current location of the keychain device in the location database. The computer-executable instructions further cause the VKM computer device to compare the first location identifier to one or more of a plurality of location identifiers for the keychain device, wherein the plurality of location identifiers comprises an authorized location zone for the keychain device. The computer-executable instructions also cause the VKM computer device to transmit the current location to a client computer device operated by a vehicle owner. The computer-executable instructions further cause the VKM computer device to determine that the location of the keychain device does not match one or more of the plurality of location identifiers for the keychain device. The computer-executable instructions also cause the VKM computer device to generate an alert indicating that the keychain device is not physically within the authorized location zone for the keychain device. The computer-executable instructions further cause the VKM computer device to transmit the alert to the client computer device, causing the client computer device to update a display with the alert and the current location of the keychain device.

BRIEF DESCRIPTION OF THE DRAWINGS

FIGS. 1-8 show example embodiments of the methods and systems described herein.

FIG. 1 is a schematic diagram illustrating an environment in which various devices communicate with a server device to enable the server device to perform vehicle key monitoring.

FIG. 2 illustrates an example configuration of a user system operated by a user, such as vehicle dealership personnel or a vehicle owner.

FIG. 3 illustrates an example configuration of a server system used for tracking the location of keychain devices.

FIG. 4 illustrates an example configuration of a keychain device that is configured to transmit its location to, for example, a server device.

FIG. 5A illustrates an example display of a client device showing a keychain device as being on an authorized path.

By contrast, FIG. 5B illustrates client device showing a keychain device as being on an unauthorized path.

FIG. 8 is an example method implemented by a server device for tracking keychain devices.

Like numbers in the Figures indicate the same or functionally similar components.

DETAILED DESCRIPTION OF THE DISCLOSURE

Figure 1:
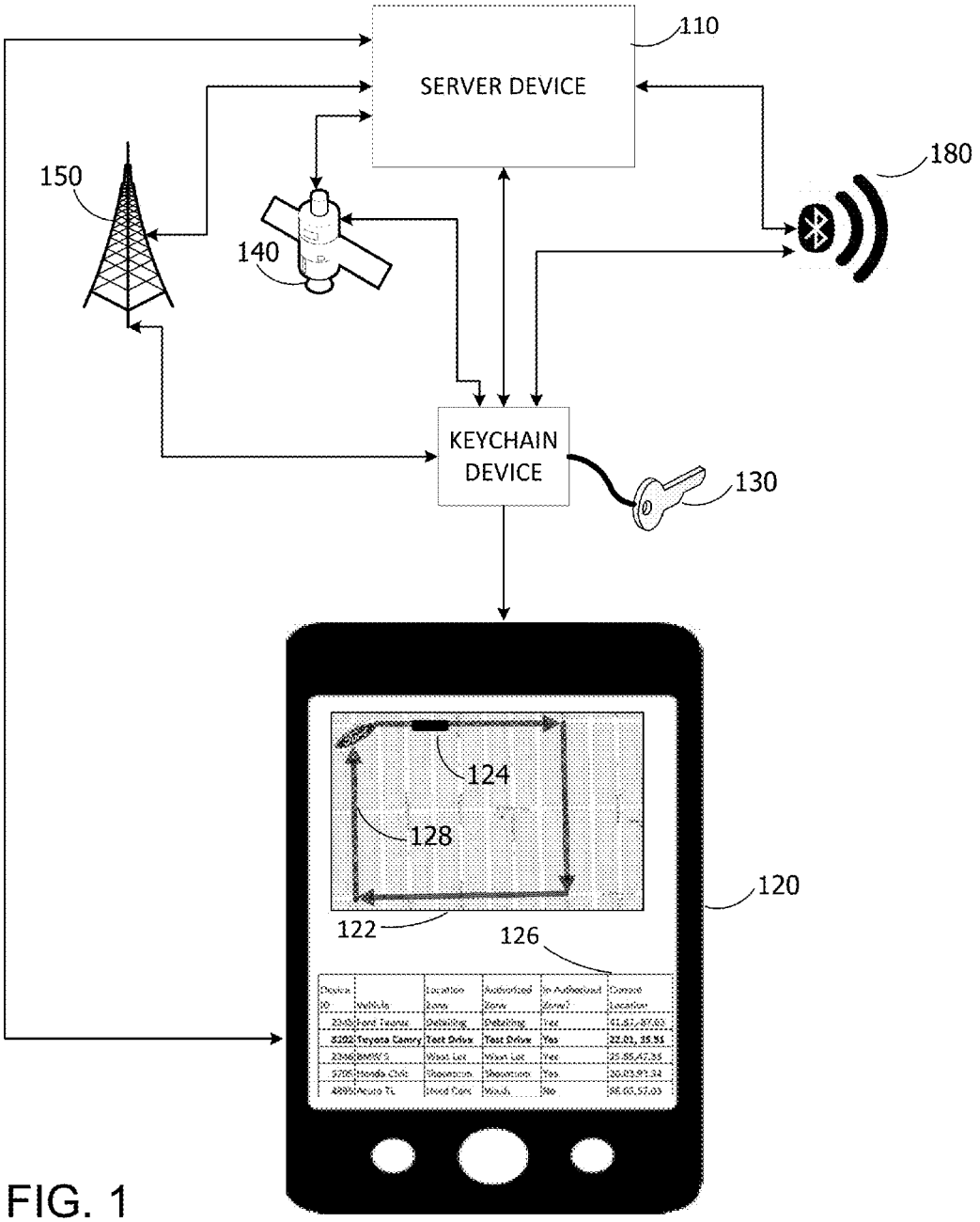

In the system described herein, a vehicle key monitoring computing device ("VKM computing device") provides a vehicle owner (whether dealership, or prospective or current vehicle owner) with the ability to continuously monitor the location of the keys for each vehicle in its control. The VKM computing device is in communication with a location database. For example, the location database may be configured to store the locations of vehicle key tracking devices as sets of location identifiers. The VKM computing device is configured to receive location information about vehicle keys ("current location") either directly from a physical tracking device ("keychain device"), or via an external computing device, such as one associated with a satellite, cellular phone tower, or Bluetooth-enabled device. The VKM computing device is also configured to update the location database at configurable intervals with the current location of each keychain device and determine whether a particular vehicle key is in an unauthorized location. The VKM computing device includes a processor coupled to a memory. In one embodiment, the VKM computing device is part of a vehicle owner's local systems, e.g., a dealership's enterprise system or a car owner's home computer. In another embodiment, the VKM computing device is installed on a central system separate from the vehicle owner's systems, where it is accessed remotely and may be shared across vehicle owners.

In at least some implementations, the VKM computing device transmits current location information for multiple keychain devices to a client device. Users may wish to locate multiple keychain devices associated with, for example, all vehicles of a particular make, model, year, or color. On demand from a user, the VKM computing device queries the location database to retrieve the current locations of multiple location devices and present them to a user. Additional components include a keychain device that is securely attached to or otherwise integrated with the vehicle keys. Each keychain device has an associated keychain device ID, used to identify the keychain device in the location database as well as associate the keychain device with a vehicle. The keychain device uses GPS or similar technology to determine its location. The keychain device is equipped with a signal transmission and reception device and, in at least some implementations, regularly transmits its location to the VKM computing device in the form of, for example, geographic coordinates or some other location identifier. The keychain device may use one or more of cellular, GSM, Bluetooth, and radio frequency (RF) signals to transmit its location.

Additional components of the system also include a client computing device, e.g., a smartphone or personal computer of a user. In at least some implementations, the client computing device includes a processor configured to receive location data, transmit commands to the VKM computing device, and receive alerts from the VKM computing device, such as in the event that the keychain device is not in its authorized location.

In at least some implementations, the client computing device is configured to display a location of the keychain device on a user's smartphone or other personal computer. The client computing device receives the keychain device's location from the VKM computing device and converts it into a visual display. For example, the client computing device may display a map on a smartphone display screen and represent the location of the keychain device as a colored dot or other marker. The client computing device also displays the location zone that the keychain device is currently authorized to be in. Accordingly, the keychain device may appear within the location zone, or outside it, on the display. If the keychain device is outside the location zone, the client computing device will display an alert on the screen and/or play a sound. Similarly, if the keychain device has exceeded a particular time interval for staying within a location zone, the client computing device displays an alert, along with the amount of time the keychain device has stayed past the authorized time interval. For example, if the keychain device was authorized to be in the dealership's service center between the hours of 1:00 PM and 2:00 PM, then after 2:00 PM the client computing device will display or sound an alert if the keychain device remains in the service center after 2:00 PM.

In at least some implementations, the client computing device is configured to select a particular set of keychain devices for monitoring. The client computer device displays an interface comprising a search facility and an ability to filter by multiple parameters (e.g., make, model, year). Keychain devices can be displayed as a list or on a map. The client computing device enables the user to select a particular keychain device and review its location history, e.g., where the keychain device has been located within the past 24 hours or past week.

Vehicle owners will associate each keychain device with a particular vehicle. In at least some implementations, a vehicle owner will scan a photograph of a vehicle's Vehicle Identification Number (VIN) and upload the photograph to a vehicle database. The VKM computing device accesses the photograph, performs optical character recognition (OCR) functions on the photograph to read the VIN and associate it with a particular keychain device. The keychain device ID is associated with the VIN in the vehicle database. This enables the vehicle owner to use the client computing device to view, at a glance, additional vehicle details, e.g., color, make, model, and year.

Vehicle owners will define particular physical location zones for vehicle keys ("key location zones"), such as by selecting a point and defining a radius around it. Vehicle owners can then set one or more key location zones as the location(s) where the vehicle keys are currently authorized to be ("authorized zone"). Similarly, vehicle owners can define particular paths, e.g., a test drive route on which a prospective buyer is allowed to drive a vehicle for testing. The VKM computing device stores each key location zone and path as, for example, a set of geographic coordinates. The VKM computing device regularly receives, from keychain devices or external computing devices, signals bearing the current location of the keychain device, in the form of location identifiers, such as geographic coordinates. The VKM computing device continuously compares the current location of the keychain device with the key location zones or paths that are set as the currently authorized location. On demand from the client computing device, the VKM computing device transmits the current location of the keychain device, for display on the client computing device. If the VKM computing device determines that a keychain device has exited the authorized zone or strayed from an authorized path, the VKM computing device transmits an alert to the client computing device. The VKM computing device causes the client computing device to alert the user by a visual display change and/or an audible alert.

In at least some implementations, VKM computing device is configured to perform statistical analysis and reporting on the keychain device. The VKM computing device determines the historical locations of the keychain device within a defined time period in the past, and determines the number of occasions the keychain device was not in an authorized location zone. Using this information, the VKM computing device reports on how many times a particular authorized zone was breached, whether certain zones are more susceptible to breach, and enables a user to adjust the authorized locations for vehicle keys accordingly.

At least one of the technical problems addressed by this system includes: (i) vehicle key loss due to misplacement or theft, and (ii) inability to determine when a vehicle or vehicle key has left an authorized zone, whether due to deliberate or inadvertent acts.

The methods and systems described herein may be implemented using computer programming or engineering techniques including computer software, firmware, hardware, or any combination or subset thereof, wherein the technical effects may be achieved by performing at least one of the following steps: (a) receiving, from a location transmitter device, a current location of the keychain device, including a first location identifier, (b) storing the current location of the keychain device in the location database, (c) comparing the first location identifier to one or more of a plurality of location identifiers for the keychain device, wherein the plurality of location identifiers comprises an authorized location zone for the keychain device, (d) transmitting the current location to a client computer device operated by a vehicle owner, (e) determining that the location of the keychain device does not match one or more of the plurality of location identifiers for the keychain device, (f) generating an alert indicating that the keychain device is not physically within the authorized location zone for the keychain device, and (g) transmitting the alert to the client computer device, causing the client computer device to update a display with the alert and the current location of the keychain device.

The resulting technical benefits achieved by this system include at least one of: (i) enabling vehicle key owners to accurately track the physical location of their keys, and (ii) quickly determining the causes and actors responsible for loss or even unauthorized relocation of vehicle keys.

As used herein, a processor may include any programmable system including systems using micro-controllers, reduced instruction set circuits (RISC), application specific integrated circuits (ASICs), logic circuits, and any other circuit or processor capable of executing the functions described herein. The above examples are example only, and are thus not intended to limit in any way the definition and/or meaning of the term "processor."

As used herein, the terms "software" and "firmware" are interchangeable, and include any computer program stored in memory for execution by a processor, including RAM memory, ROM memory, EPROM memory, EEPROM memory, and non-volatile RAM (NVRAM) memory. The above memory types are example only, and are thus not limiting as to the types of memory usable for storage of a computer program.

As used herein, the term "current location" refers to where the keychain device is physically located at a particular time. The location may be denoted by one or more location identifiers, including, but not limited to, geographic coordinates (e.g., latitude and longitude, or DMS (degrees minutes seconds)), distance from a user device, with reference to a locator device (such as a Bluetooth enabled device), with reference to parts of a map (such as using labeled sectors 1-10 and A-Z, e.g., A9, G3), using cardinal direction points, or any other method used to describe the physical location of an object.

In one embodiment, a computer program is provided, and the program is embodied on a computer readable storage medium. In an example embodiment, the system is executed on a single computer system, without requiring a connection to a server computer. In a further embodiment, the system is being run in a Windows® environment (Windows is a registered trademark of Microsoft Corporation, Redmond, Wash.). In yet another embodiment, the system is run on a mainframe environment and a UNIX® server environment (UNIX is a registered trademark of X/Open Company Limited located in Reading, Berkshire, United Kingdom). The application is flexible and designed to run in various different environments without compromising any major functionality. In some embodiments, the system includes multiple components distributed among a plurality of computing devices. One or more components may be in the form of computer-executable instructions embodied in a computer-readable medium. The systems and processes are not limited to the specific embodiments described herein. In addition, components of each system and each process can be practiced independent and separate from other components and processes described herein. Each component and process can also be used in combination with other assembly packages and processes.

The following detailed description illustrates embodiments of the disclosure by way of example and not by way of limitation. It is contemplated that the disclosure has general application to device tracking in industrial, commercial, and residential applications.

As used herein, an element or step recited in the singular and proceeded with the word "a" or "an" should be understood as not excluding plural elements or steps, unless such exclusion is explicitly recited. Furthermore, references to "example embodiment" or "one embodiment" of the present disclosure are not intended to be interpreted as excluding the existence of additional embodiments that also incorporate the recited features.

FIG. 1 is a schematic diagram illustrating an environment 100 in which various devices communicate with a server device 110 to enable server device 110 to perform vehicle key monitoring. In the example embodiment, server device 110 is in communication with a client device 120 and a keychain device 130. In at least some embodiments, server device 110 is also in communication with location transmitter devices. Location transmitter devices include a satellite 140, a cell phone tower 150, and a Bluetooth enabled device 180.

In one embodiment, server device 110 receives location information directly from keychain device 130. In this embodiment, location information may be received via one or more communication protocols, such as Bluetooth. Additionally, keychain device 130 also transmits additional information, such as battery life for keychain device 130. In another embodiment, server device 110 receives location information from satellite 140 via communication protocols such as the Global Positioning System (GPS). In yet another embodiment, server device 110 receives location information from cell phone tower 150, via communication protocols such as GSM or CDMA. In a further embodiment, server device 110 receives location information from a Bluetooth enabled device 180, such as a Bluetooth beacon or other Bluetooth enabled transmitter, receiver, transponder, or transceiver. Location information may comprise, for example, the geographic coordinates of keychain device 130, representing the physical location of keychain device 130, or some other location identifier. In one embodiment, server device 110 receives location information in communication pulses set at predetermined intervals, such as once every 100 milliseconds, or once every second, or once every minute.

Server device 110 is configured to receive location information via a variety of communication protocols and in a variety of formats. Server device 110 is configured to communicate back to location transmitter devices, whether to acknowledge receipt of location information, perform communication health checks, transmit error messages, software updates, and the like. Server device 110 is further configured to process received location information, store location information in a database, and transmit location information to client device 120.

Client device 120 is at least configured to receive location information from server device 110 or directly from keychain device 130 via Bluetooth technology. Client device is configured to receive location information in the form of one or more location identifiers, such as geographic coordinates, direction identifiers, distance values, address values, and the like. In one embodiment, client device 120 processes location information and displays it on a display screen in one or more formats. In the exemplary embodiment, client device 120 displays a location of the keychain device using map view 122 and text view 126. Map view 122 displays a contextual map of the current location of keychain device 130, and periodically updates the display as the current location of keychain device 130 changes. In the exemplary embodiment, keychain device 130 is represented on map view 122 as car 124, traveling on a street displayed on a map. Map view 122 also displays authorized route 128, representing the route that the keychain device is authorized to travel on. In the exemplary embodiment, car 124 is shown traveling authorized route 128 starting from a Ford car dealership, e.g., on a test drive, wherein authorized route 128 is shown on map view 122 as a roughly rectangular path beginning and ending at the dealership.

Text view 126 displays the current location of one or more keychain devices (along with associated vehicles) that are being tracked using server device 110. In the exemplary embodiment, text view 126 displays the current location of at least five keychain devices, one of which is associated with car 124, i.e., the vehicle holding keychain device 130. Car 124 is shown on text view 126 in bold as a Toyota Camry with device ID 3202. Text view 126 shows a location zone that keychain device 130 is currently in (test drive), the authorized zone for keychain device 130 (test drive), whether keychain device 130 is actually within the authorized zone (yes), and the current location of keychain device 130 (shown as latitude and longitude coordinates).

In the exemplary embodiment, keychain device 130 communicates directly with server device 110 to send and receive location and tracking information. In other embodiments, keychain device 130 communicates instead (or in addition) with satellite 140, cell phone tower 150, and Bluetooth enabled device 180 directly.

Figure 2:
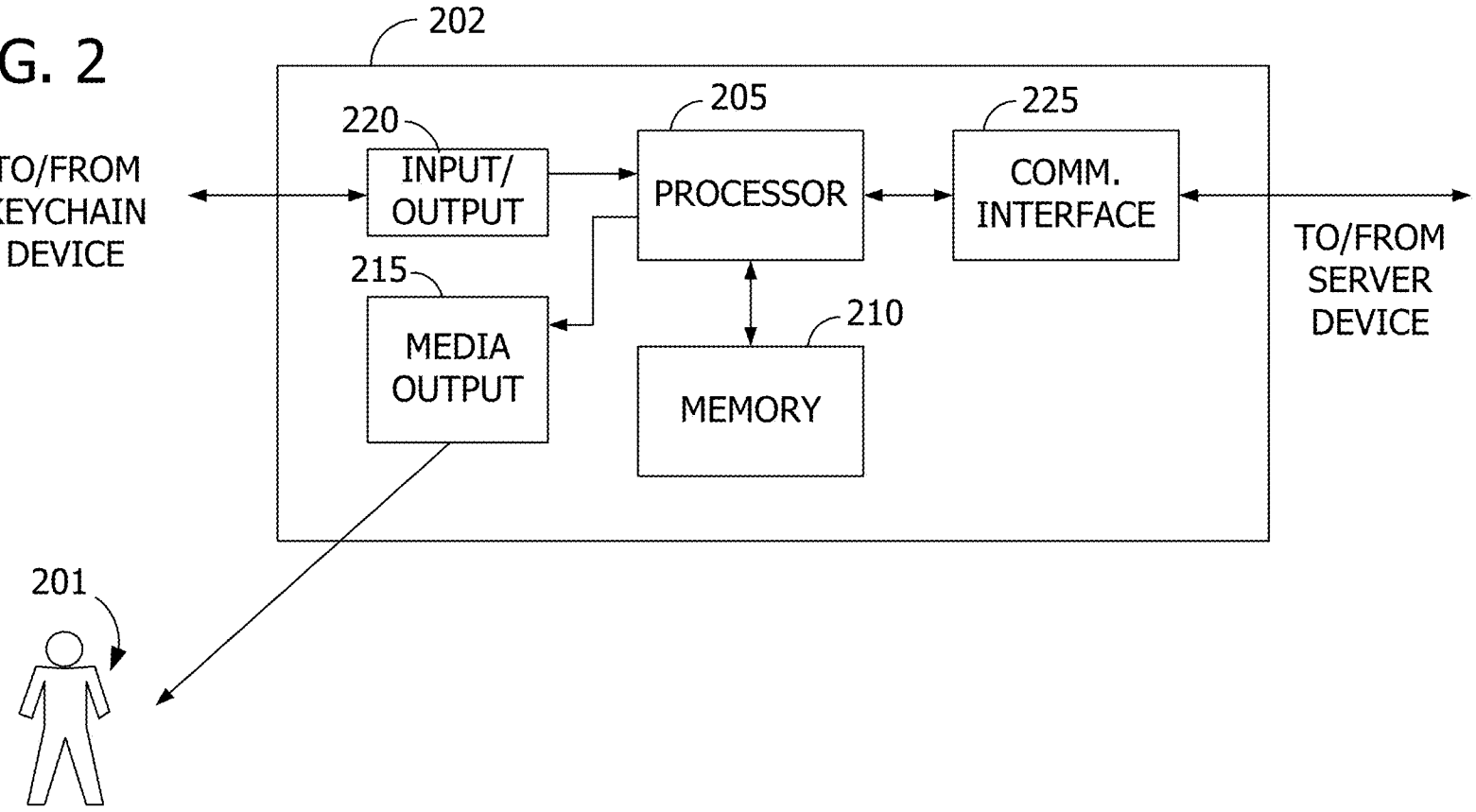

FIG. 2 illustrates an example configuration of a user system 202 (similar to client device 120, shown in FIG. 1) operated by user 201, such as vehicle dealership personnel or a vehicle owner. In the example embodiment, user system 202 includes a processor 205 for executing instructions. In some embodiments, executable instructions are stored in a memory area 210. Processor 205 may include one or more processing units, for example, a multi-core configuration. Memory area 210 is any device allowing information such as executable instructions and/or written works to be stored and retrieved. Memory area 210 may include one or more computer readable media.

User system 202 also includes at least one media output component 215 for presenting information to user 201. Media output component 215 is any component capable of conveying information to user 201. In some embodiments, media output component 215 includes an output adapter such as a video adapter and/or an audio adapter. An output adapter is operatively coupled to processor 205 and operatively connectable to an output device such as a display device, a liquid crystal display (LCD), organic light emitting diode (OLED) display, or "electronic ink" display, or an audio output device, a speaker or headphones.

In some embodiments, user system 202 includes an input device 220 for receiving input from user 201. Input device 220 may include, for example, a keyboard, a pointing device, a mouse, a stylus, a touch sensitive panel, a touch pad, a touch screen, a gyroscope, an accelerometer, a position detector, or an audio input device. A single component such as a touch screen may function as both an output device of media output component 215 and input device 220. User system 202 may also include a communication interface 225, which is communicatively connectable to a remote device such as server device 110. Communication interface 225 may include, for example, a wired or wireless network adapter or a wireless data transceiver for use with a mobile phone network, Global System for Mobile communications (GSM), 3G, or other mobile data network or Worldwide Interoperability for Microwave Access (WIMAX).

Stored in memory area 210 are, for example, computer readable instructions for providing a user interface to user 201 via media output component 215 and, optionally, receiving and processing input from input device 220. A user interface may include, among other possibilities, a web browser and client application. Web browsers enable users, such as user 201, to display and interact with media and other information typically embedded on a web page or a website from server device 110. A client application allows user 201 to interact with a server application from server device 110.

Figure 3:
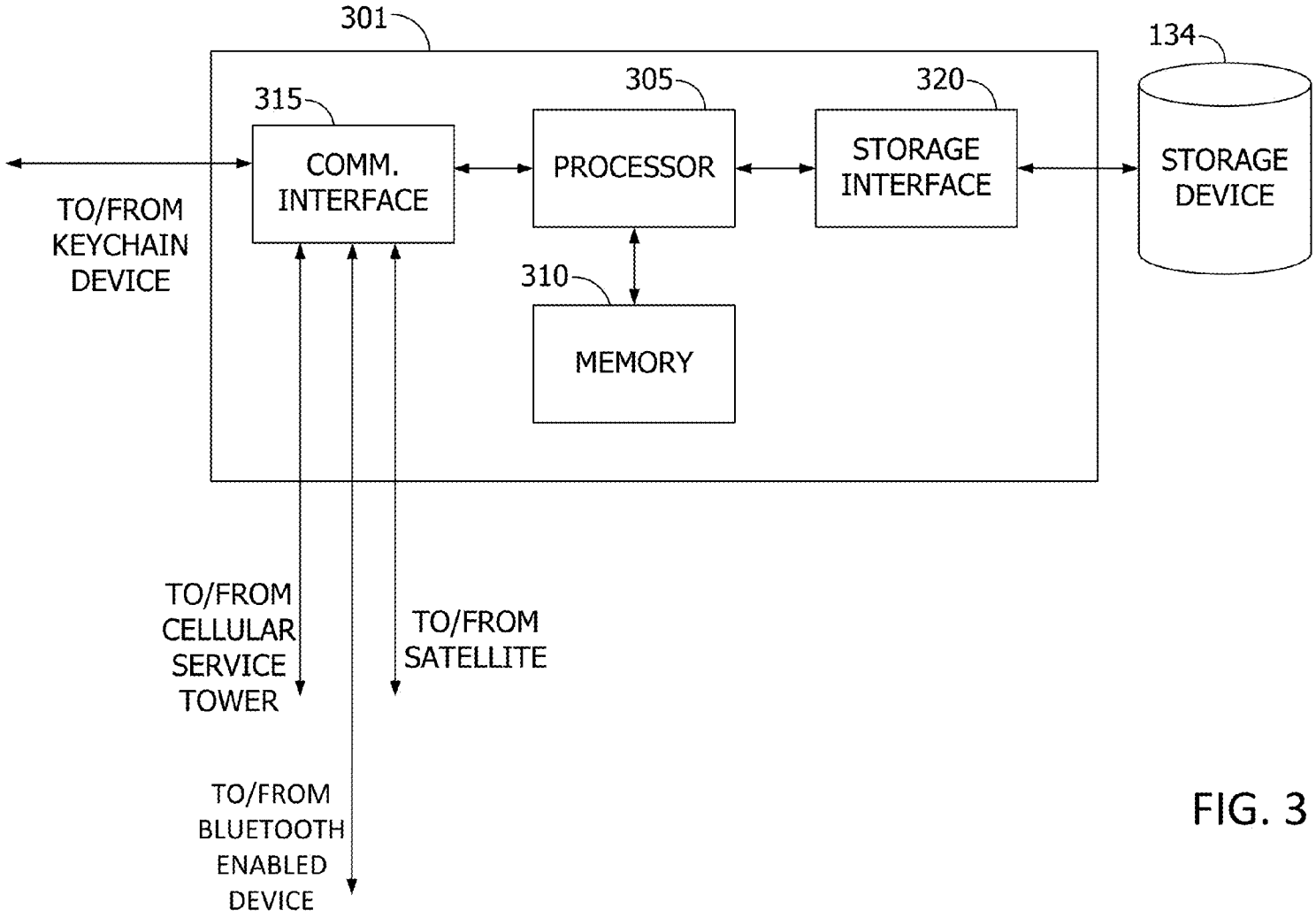

FIG. 3 illustrates an example configuration of a server system 301 such as server device 110 (shown in FIG. 1) used for tracking the location of keychain device 130 (shown in FIG. 1). Server system 301 includes a processor 305 for executing instructions. Instructions may be stored in a memory area 310, for example. Processor 305 may include one or more processing units (e.g., in a multi-core configuration) for executing instructions. The instructions may be executed within a variety of different operating systems on the server system 301, such as UNIX, LINUX, Microsoft Windows®, etc. It should also be appreciated that upon initiation of a computer-based method, various instructions may be executed during initialization. Some operations may be required in order to perform one or more processes described herein, while other operations may be more general and/or specific to a particular programming language (e.g., C, C#, C++, Java, or other suitable programming languages, etc.).

Processor 305 is operatively coupled to a communication interface 315 such that server system 301 is capable of communicating with a remote device such as user system 202 or another server system 301. For example, communication interface 315 may receive location information from keychain device 130, satellite 140, cell phone tower 150, or Bluetooth enabled device 180 (as shown in FIG. 1).

Processor 305 may also be operatively coupled to a storage device 134. Storage device 134 is any computer-operated hardware suitable for storing and/or retrieving data. In some embodiments, storage device 134 is integrated in server system 301. For example, server system 301 may include one or more hard disk drives as storage device 134. In other embodiments, storage device 134 is external to server system 301 and may be accessed by a plurality of server systems 301. For example, storage device 134 may include multiple storage units such as hard disks or solid state disks in a redundant array of inexpensive disks (RAID) configuration. Storage device 134 may include a storage area network (SAN) and/or a network attached storage (NAS) system. Storage device 134 is configured to store location information for a plurality of keychain devices 130. Storage device 134 is also configured to store format information regarding communication protocols that various keychain devices 130 or other location transmitter devices (cell phone towers, satellites) may use to communication location information to server system 301.

In some embodiments, processor 305 is operatively coupled to storage device 134 via a storage interface 320. Storage interface 320 is any component capable of providing processor 305 with access to storage device 134. Storage interface 320 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 305 with access to storage device 134.

Memory area 310 may include, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are exemplary only, and are thus not limiting as to the types of memory usable for storage of a computer program.

Figure 4:
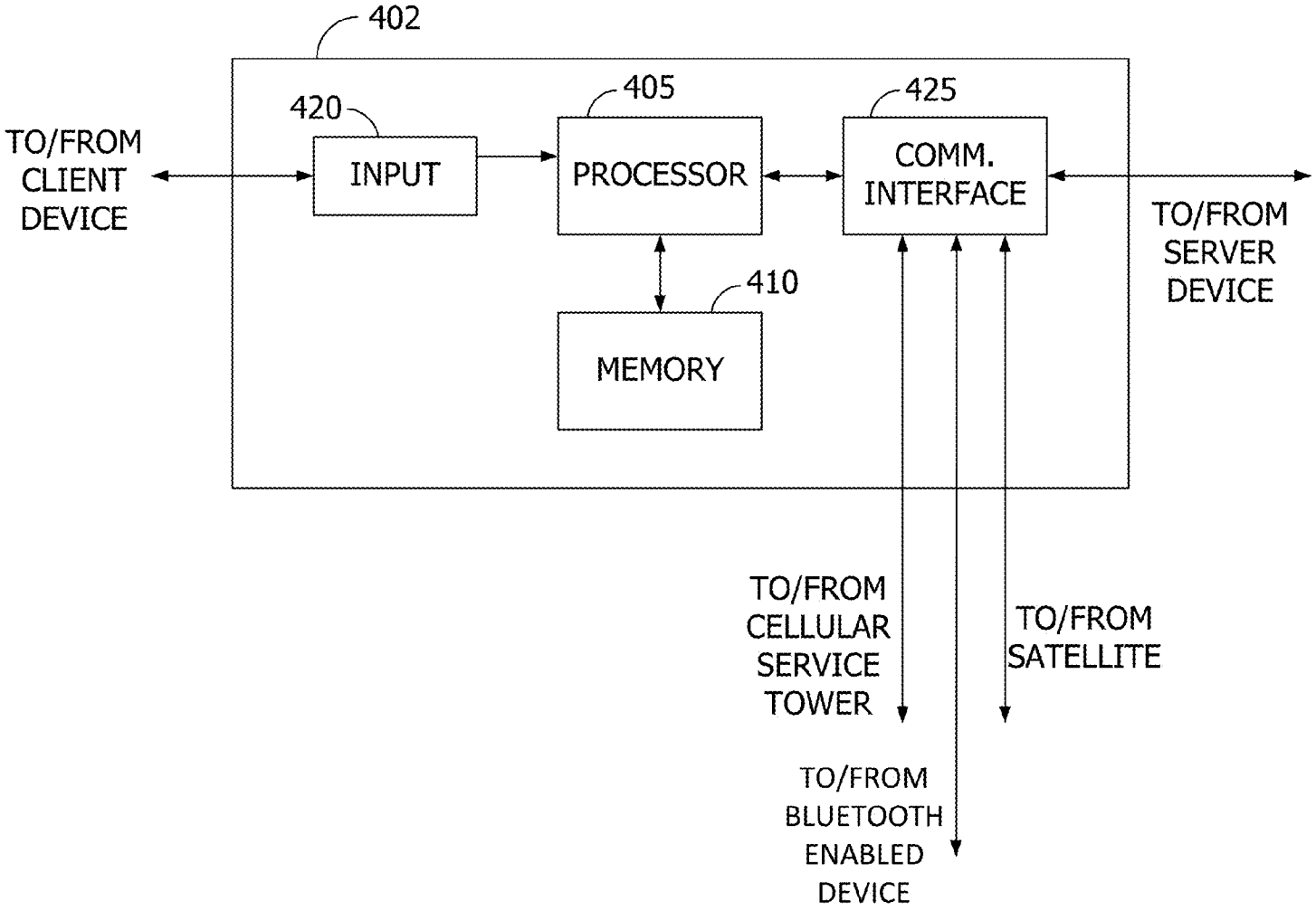

FIG. 4 illustrates an example configuration of a keychain device 402 such as keychain device 130 (shown in FIG. 1) that is configured to transmit its location to, for example, server device 110 (shown in FIG. 1). Keychain device 402 includes a processor 405 for executing instructions. Instructions may be stored in a memory area 410, for example. Processor 405 may include one or more processing units (e.g., in a multi-core configuration) for executing instructions. The instructions may be executed within a variety of different operating systems on the keychain device 402, such as UNIX, LINUX, Microsoft Windows®, etc. It should also be appreciated that upon initiation of a computer-based method, various instructions may be executed during initialization. Some operations may be required in order to perform one or more processes described herein, while other operations may be more general and/or specific to a particular programming language (e.g., C, C#, C++, Java, or other suitable programming languages, etc.).

Processor 405 is operatively coupled to a communication interface 425 such that keychain device 402 is capable of communicating with a remote device such as user system 202 or another keychain device 402. For example, communication interface 425 may transmit location information to server device 110, satellite 140, or cell phone tower 150 (as shown in FIG. 1). Communication interface 425 is configured to transmit location information using a variety of communication formats including Bluetooth, CDMA, GSM, GPS, and Wi-Fi. More specifically, communication interface 425 is configured to communicate with Bluetooth enabled devices such as a Bluetooth beacon or smart phones with Bluetooth enabled. Communication interface 425 is also configured to receive device battery life, discovery data (wherein keychain device 130 attempts to locate a nearby transmitter), battery life data, location data, and movement data such as speed or distance of movement.

Memory area 410 may include, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are exemplary only, and are thus not limiting as to the types of memory usable for storage of a computer program.

FIG. 5A illustrates an example display of client device 500 (similar to client device 120 from FIG. 1) showing a keychain device as being on an authorized path. In the exemplary embodiment, client device 500 includes map view 510 and text view 530. As mentioned with respect to client device 120, client device 500 receives location information in the form of location identifiers, such as geographic coordinates. Map view 510 displays car 502 traveling on an authorized path 520, such as on a test drive from a car dealership. Alternatively, map view 510 may display a tracking dot, pointer, or other device icon to denote a keychain device itself (e.g., in situations where the keychain device is not in proximity with a vehicle). In other embodiments, authorized path 520 may represent any path defined by a user, such as that defined for a student driver for practice, or an agreed-upon path between a parent and the parent's child who is in control of car 502 and keychain device 130. Text view 530 also displays car 502 in bold as a Toyota Camry with device ID 3202. Text view 530 shows a location zone that keychain device 130 is currently in (test drive), the authorized zone for keychain device 130 (test drive), whether keychain device 130 is actually within the authorized zone (yes), and the current location of keychain device 130 (shown here as latitude and longitude coordinates). As will be appreciated by those having skill in the art, server device 110 (shown in FIG. 1) continuously compares the location identifiers (e.g., the geographic coordinate set) defining authorized path 520 with the location identifier of keychain device 130. If there is a match between authorized path 520 and keychain device 130's current location (based on a geographic coordinate comparison) server device 110 determines keychain device 130 is on the authorized path and communicates this to client device 500. Client device 500 then displays "Yes" in the column marked "In Authorized Zone?" on text view 530.

By contrast, FIG. 5B shows client device 500 showing a keychain device as being on an unauthorized path. In the exemplary embodiment, map view 510 displays car 502 and authorized path 520. However, car 502 is no longer on authorized path 520 and instead has deviated onto unauthorized path 560. Map view 510 shows car 502's current location, deviation from authorized path 520, and current trajectory. As noted earlier, client device 500 receives location information from server device 110 (shown in FIG. 1) and is able to continuously update its display to show the current location of a keychain device (e.g. keychain device 130 from FIG. 1) and its associated vehicle, whether authorized or not. In this embodiment, server device 110 determines that keychain device 130 is no longer on authorized path 520. Server device 110 determines that there is a mismatch between, e.g., the geographic coordinate set defining authorized path 520 and that for the current location of keychain device 130. Server device 110 communicates this mismatch to client device 500, which displays "No" in the column marked "In Authorized Zone?" in text view 530. Even after the deviation onto unauthorized path 560, server device 110 continues to track the location of keychain device 130, communicating the current location to client device 500 continuously. Client device 500 processes this location information and displays the current path of car 502 on map view 510 as unauthorized path 560.

Figure 6A:
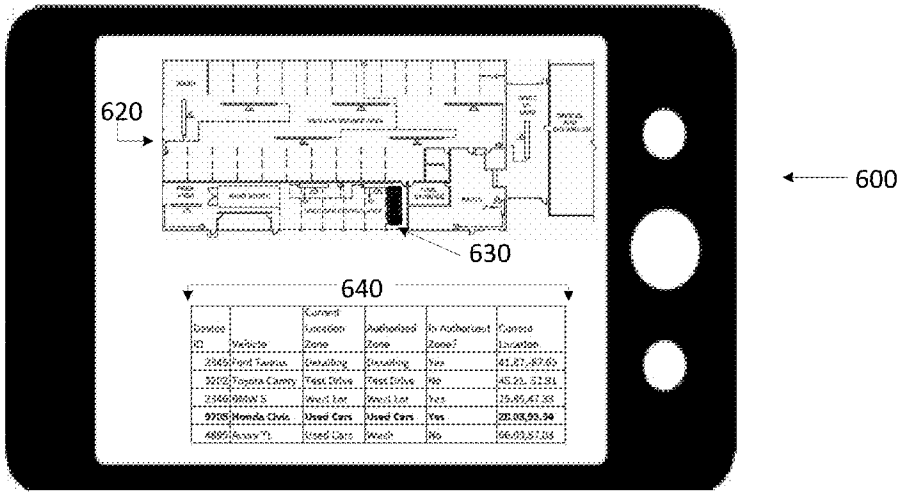
FIG. 6A illustrates a client device showing a keychain device in an unauthorized zone.
Figure 6B:
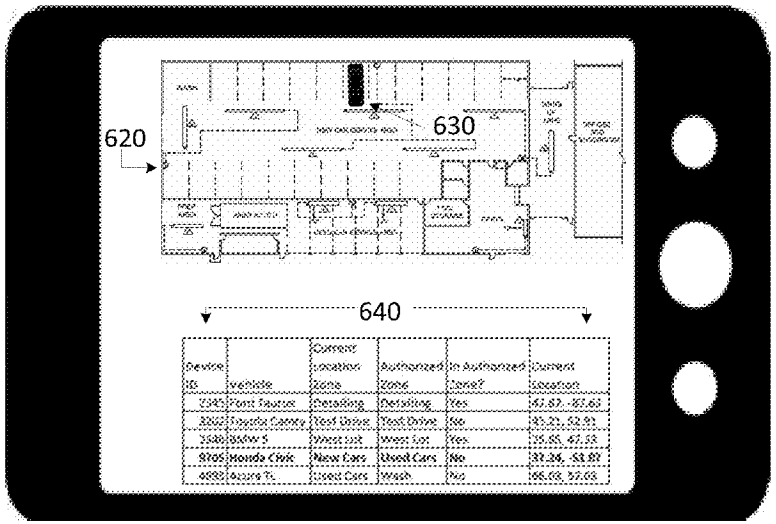
FIG. 6B illustrates a client device showing a keychain device in an unauthorized zone.

FIG. 6A shows client device 600 (similar to client device 120 in FIG. 1 and client device 500 in FIG. 5) displaying map view 620, and text view 640. Map view 620 displays a car icon 630, representing the current location of a keychain device (such as keychain device 130). Similarly, text view 640 displays information regarding the keychain device, such as the device ID (9705), the vehicle associated with the keychain device (Honda Civic), the current location zone (used cars), the authorized zone (used cars), whether the keychain device is in the authorized zone (yes), and its current location (given by latitude and longitude coordinates). Similarly, FIG. 6B shows client device 600 showing car 603 (and associated keychain device) in an unauthorized zone (new cars) instead of used cars.

Figure 7C:
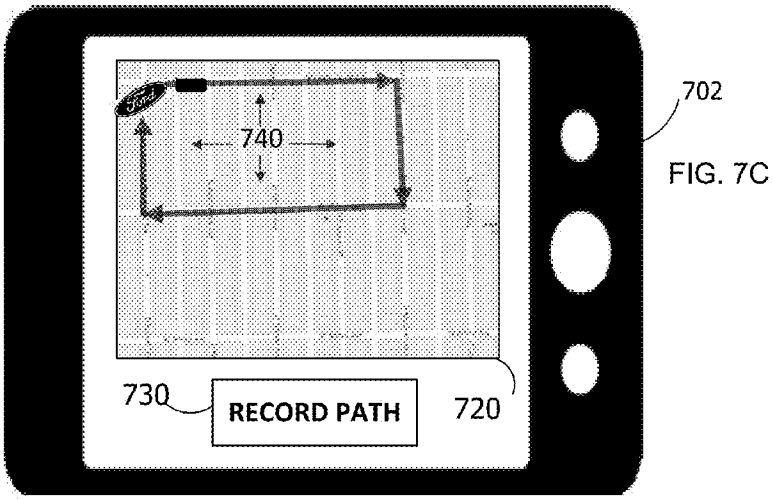
FIG. 7C illustrates a client device configured to access publicly available street maps of local areas for use in defining an authorized path.
Figure 7A:
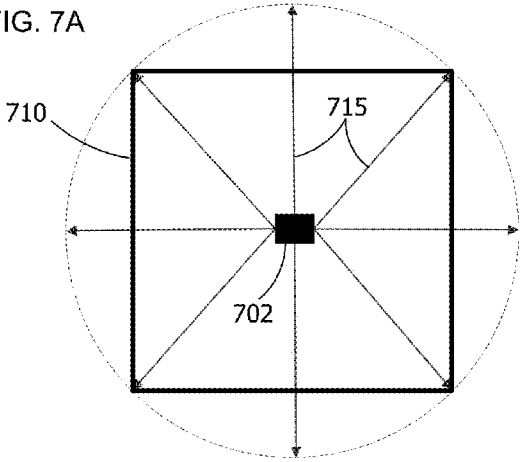
FIG. 7A illustrates how a client device may be used to define an authorized location zone while within the actual location.

FIG. 7A illustrates how a client device may be used to define an authorized location zone. In the exemplary embodiment, a user takes client device 702 (similar to client device 120 in FIG. 1) to an area 710 which is to be defined as an authorized location zone. Client device 702 is configured to determine its own geographical location (in the form of, for example, geographic coordinates or some other location identifier). Client device 702 is configured to receive radius 715 from the user, and on input by the user, and using its own geographic coordinates as the center and the provided radius, to create a virtual location zone for keychain device tracking. For example, a user may take client device 702 to the center of a vehicle dealership showroom area and press a "Define Zone" button, and provide an estimated radius of the desired area, or enter estimated length and width dimensions of the zone. Client device 702 uses this information to define the authorized zone.

Figure 7B:
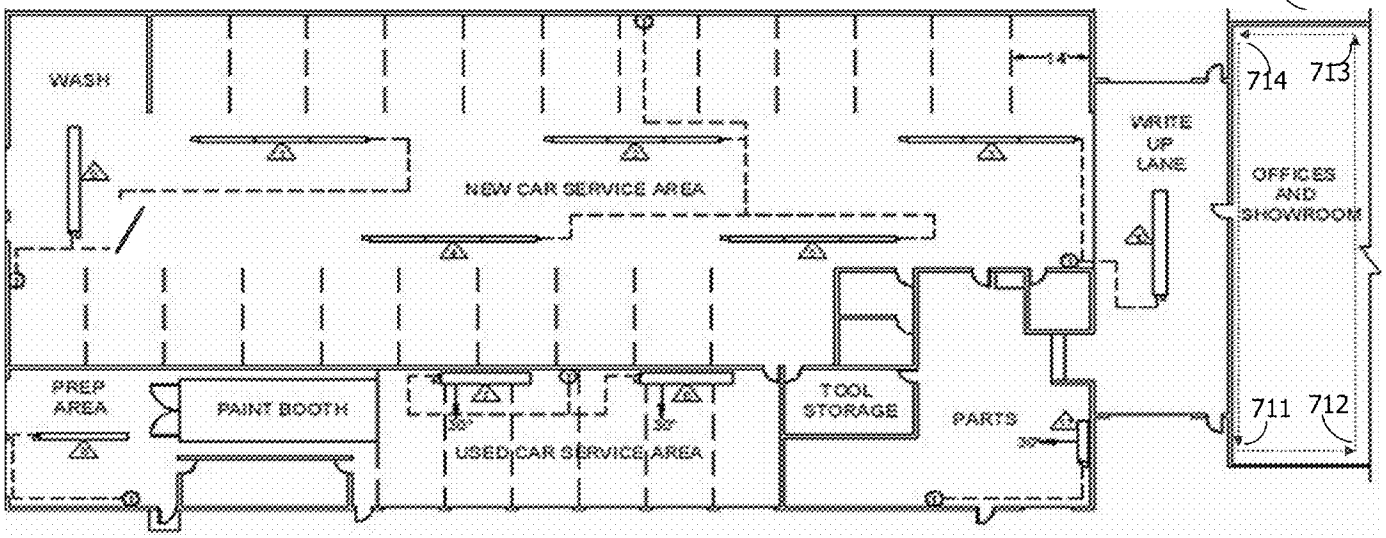
FIG. 7B, shows how a client device is also configured to receive input to define an authorized zone without being taken to the actual location.

Alternatively, in FIG. 7B, client device 702 (not shown) is also configured to receive input to define an authorized zone without being taken to the actual location. In this embodiment, client device 702 receives mapping data regarding a location, such as a vehicle dealership. Mapping data may include a location map of a dealership in the form of various location identifiers, such as geographic coordinates, length and breadth dimensions of various areas, and the like. A user is able to draw on client device 702 (using a finger or a stylus) the various location zones and label them using client device 702. In the illustrated embodiment, the "Offices and Showroom" area 720 is to be an authorized zone. A user taps or uses a stylus to outline (711 to 712 to 713 to 714) around area 720 on a map of the dealership to define a rectangular bounded area that encloses area 720 on the map. Client device 702 is configured to interpret this drawing as an authorized zone that can be labeled "Offices and Showroom." Client device 702 is further configured to upload this information to a database, such that "Offices and Showroom" will now appear in the list of potential authorized zones in, for example, text view 530 shown in FIGS. 5A and 5B.

Similarly, client device 702 is also configured to define an authorized path, such as for a test drive, using a street map (not shown). As illustrated by FIG. 7C, client device 702 is configured to access publicly available street maps of local areas on map view 720 and display them for a user. Client device 702 is configured to receive finger/stylus input wherein a user draws a path (similar to path 520 in FIGS. 5A and 5B) on the screen to define an authorized path, such as for a test drive. Client device 702 is configured to interpret this drawing as an authorized path, that can be labeled "Test Drive Path." Client device 702 is further configured to upload this information to a database, such that "Test Drive Path" will now appear in the list of potential authorized paths in, for example, text view 530 shown in FIGS. 5A and 5B. Alternatively, client device 702 is also configured to receive authorized path input by being physically transported on the intended path. In this embodiment (not shown), client device 702 displays a button 730 labeled "Record Path" to a user. The user presses "Record Path" button 730 and moves client device 702 along the path intended to be authorized (such as by driving on the path). During recording, client device 702 is configured to record its own geographic location as a set of location identifiers at predetermined intervals as it is moved along the path. At the conclusion of the path, the user presses the "Record Path" button again to indicate that recording is completed. Client device 702 saves the sequence of location identifiers as an authorized path 740 and uploads the sequence to a database, for use in future tracking of keychain devices. Alternatively, map view 720 may display color coding to denote authorized zones or paths (e.g., all authorized zones are marked in green). Alternatively, various authorized zones may be denoted using different colors (e.g., green path for test drive route, orange area for the showroom, blue area for the shop, etc.

Figure 8:
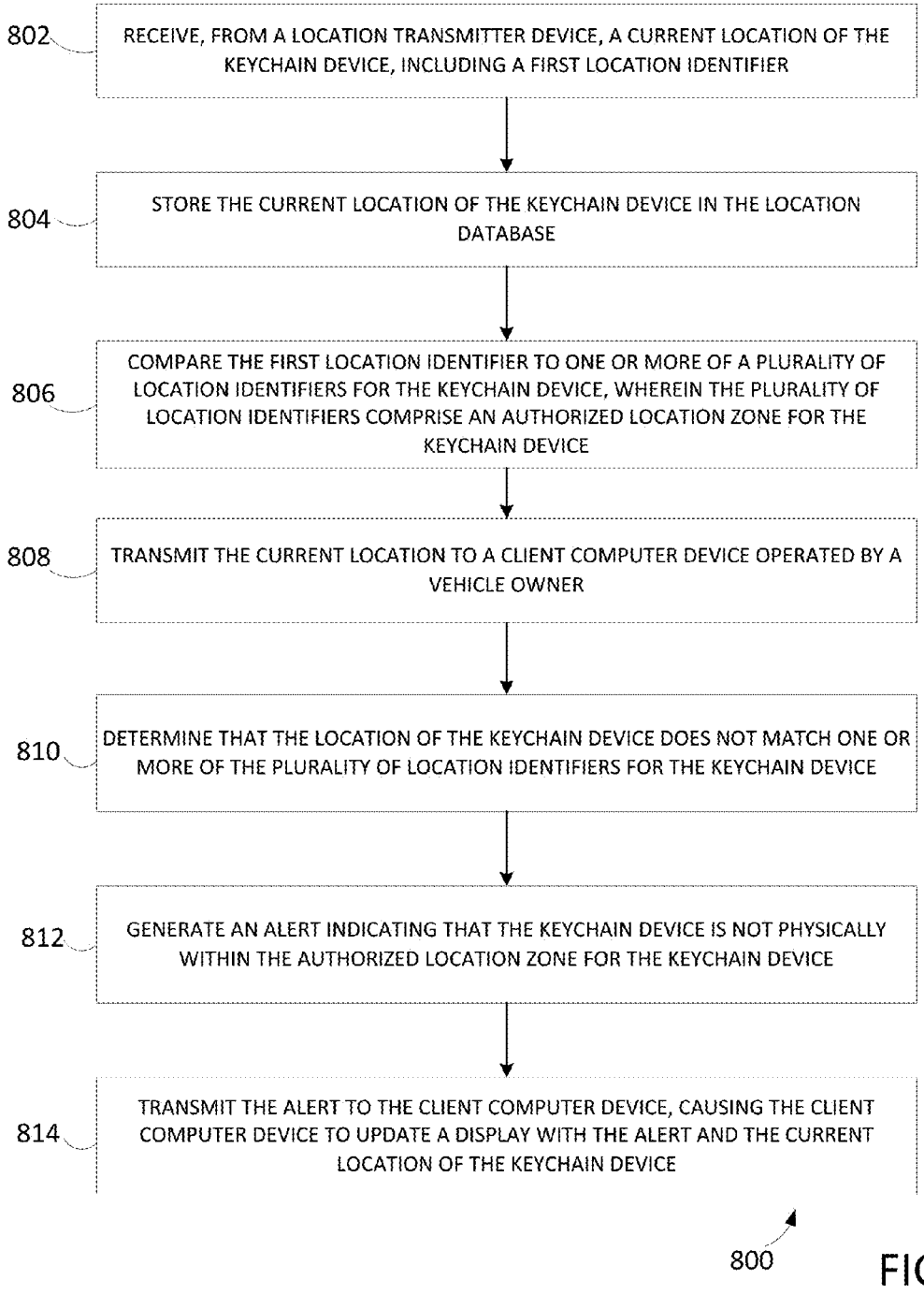

FIG. 8 is an example method 800 implemented by a server device 110, similar to server device 110 (shown in FIG. 1) for tracking keychain devices. In the exemplary embodiment, server device 110 receives 802, from a location transmitter device, a current location of the keychain device, including a first location identifier. Server device 110 then stores 804 the current location of the keychain device in the location database. Server device 110 then compares 806 the first location identifier to one or more of a plurality of location identifiers for the keychain device, wherein the plurality of location identifiers comprises an authorized location zone for the keychain device. Server device 110 transmits 808 the current location to a client computer device operated by a vehicle owner. Server device 110 determines 810 that the location of the keychain device does not match one or more of the plurality of location identifiers for the keychain device. Subsequently, server device 110 generates 812 an alert indicating that the keychain device is not physically within the authorized location zone for the keychain device. Finally, server device 110 transmits 814 the alert to the client computer device, causing the client computer device to update a display with the alert and the current location of the keychain device.

Figure 9:
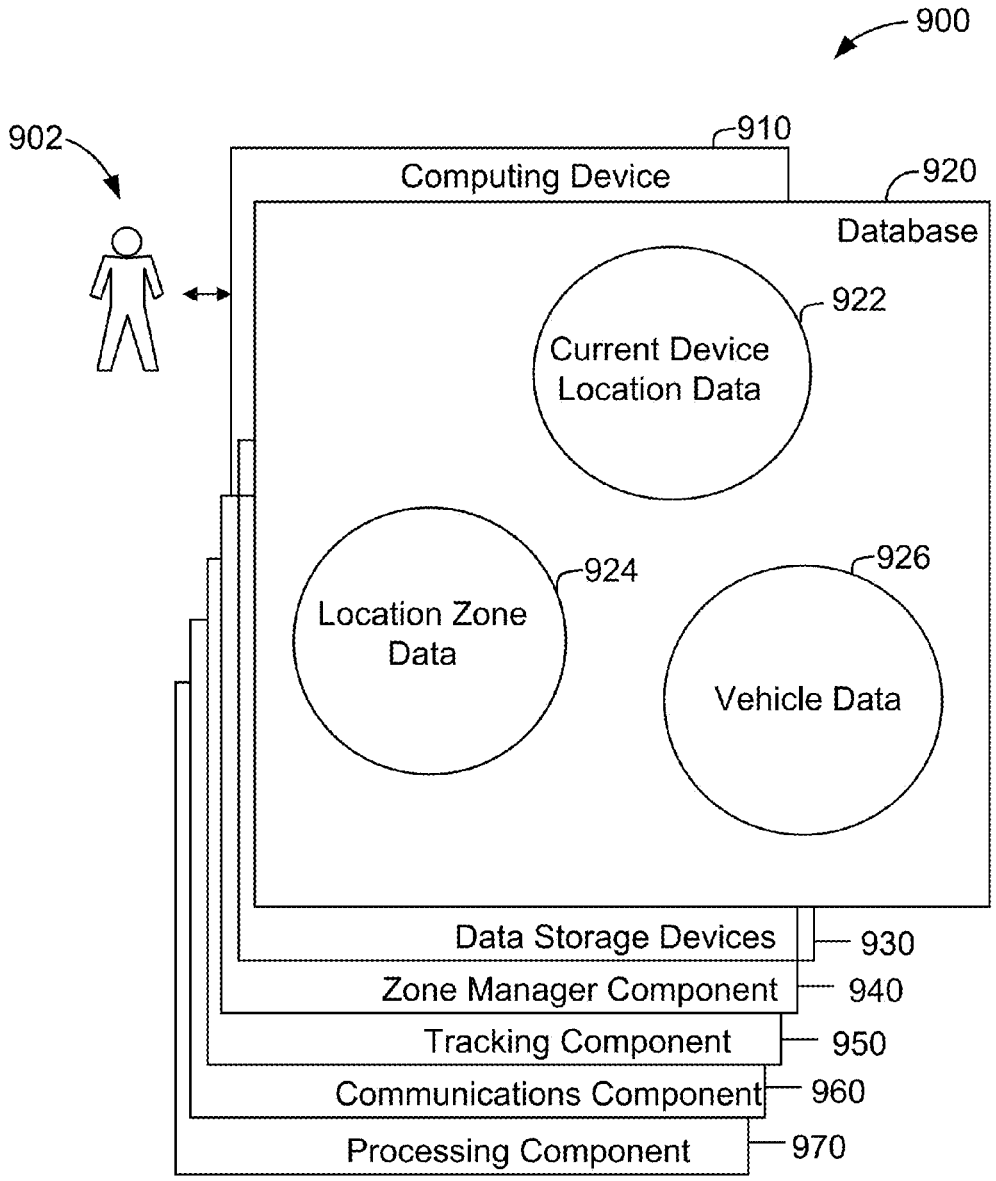
FIG. 9 shows an example configuration of a database within a computing device, along with other related computing components, that may be used to track vehicle keys.

FIG. 9 shows an example configuration 900 of a database 920 within a computing device, along with other related computing components, that may be used to track vehicle keys. In some embodiments, computing device 910 is similar to server device 110 (shown in FIG. 1). Database 920 is coupled to several separate components within computing device 910, which perform specific tasks. A user 902 may access computing device 910 to manage the location of keychain devices.

In the example embodiment, database 920 includes current device location data 922, location zone data 924, and vehicle data 926. Current device location data 922 includes information associated with keychain devices, such as device ID, battery life, device age, associated vehicle(s) etc. Location zone data 924 includes location identifier sets that define authorized location zones and authorized paths. Vehicle data 926 includes data associated with vehicles such as make, model, year, ownership, and associated keychain device.

Computing device 910 includes the database 920, as well as data storage devices 930. Computing device 910 also includes a zone manager component 940 for creating location zones. Computing device 910 also includes a tracking component 950 for processing incoming location information. A communications component 960 is also included for communicating with other servers or entities during the tracking process, e.g., a user device. A processing component 970 assists with execution of computer-executable instructions associated with the system.

Figure 10:
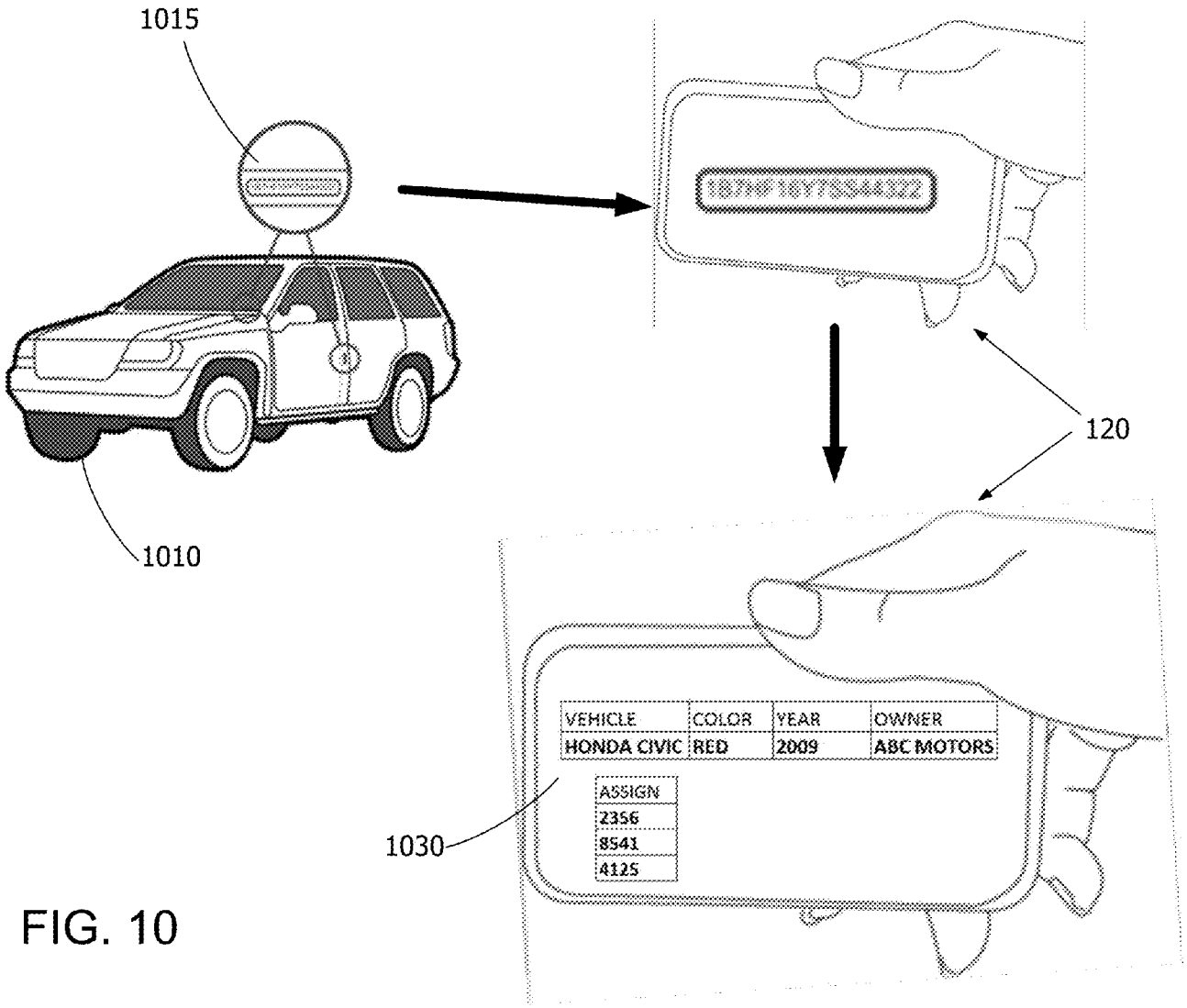
FIG. 10 shows the client device being used to associate a keychain device with a vehicle.

FIG. 10 shows client device 1020 (similar to client device 120 in FIG. 1) being used to associate a keychain device with a vehicle. In the exemplary embodiment, a vehicle 1010 has a Vehicle Identification Number (VIN) 1015 visibly displayed on some part of the vehicle, such as on the dashboard or on the inside of a door. A user uses client device 1020 equipped with a camera to a take a photograph of VIN 1015 off vehicle 1010. Client device 1020 is configured to perform optical character recognition (OCR) on the taken photograph to recognize the alphanumeric characters that make up VIN 1015. Client device 1020 is additionally configured to associate VIN 1015 with keychain device 130 (similar to keychain device 130 in FIG. 1). Once the photograph is taken, client device 1020 displays a keychain device assignment screen 1030 to the user. The user can select from a list of available devices to assign to vehicle 1010, whose basic information is also displayed on client device 1020 as retrieved from a database using VIN 1015.

As will be appreciated based on the foregoing specification, the above-described embodiments of the disclosure may be implemented using computer programming or engineering techniques including computer software, firmware, hardware or any combination or subset thereof, wherein the technical effect is to track the physical location of a keychain device. Any such resulting program, having computer-readable code means, may be embodied or provided within one or more computer-readable media, thereby making a computer program product, (i.e., an article of manufacture), according to the discussed embodiments of the disclosure. The computer-readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

These computer programs (also known as programs, software, software applications, "apps", or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The "machine-readable medium" and "computer-readable medium," however, do not include transitory signals. The term "machine-readable signal" refers to any signal used to provide machine instructions and/or data to a programmable processor.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for tracking and monitoring a physical location of keys for a vehicle using a keychain device attached to the keys, said system comprising:

a location database; and a vehicle key monitoring (VKM) computer device comprising a processor and a memory and configured to be coupled to the location database, the VKM computer device further configured to:

receive, from a location transmitter device, a time identifier associated with the keychain device and a current location of the keychain device, including a first location identifier;

store the time identifier and the current location of the keychain device in the location database;

compare the first location identifier to an authorized location zone and the time identifier to an authorized time interval for the keychain device, wherein the authorized location zone includes one or more of a plurality of contiguous location identifiers;

transmit the current location to a client computer device operated by a vehicle owner;

determine that the keychain device is in an unauthorized state, comprising determining one or more of the following:

that the first location identifier fails to correspond to the plurality of contiguous location identifiers; and that the time identifier fails to correspond to the authorized time interval:

generate an alert indicating that the keychain device is in the unauthorized state; and transmit the alert to the client computer device, causing the client computer device to update a display with the alert and the current location of the keychain device.

2. A system in accordance with claim 1, wherein the VKM computer device is further configured to associate a first client computer device identifier with the keychain device.

3. A system in accordance with claim 1, wherein said VKM computer device is communicatively coupled to the client computer device, said VKM computer device further configured to:

receive, from the client computer device, a transfer indicator indicating that control of the vehicle has been transferred to a second vehicle owner, and a second client computer device identifier;

associate the second client computer device identifier with the vehicle in the location database; and remove the association between the first client computer device identifier and the vehicle from the location database.

4. A system in accordance with claim 1, wherein the VKM computer device is further configured to:

receive an image of the vehicle identification number (VIN) from the vehicle;

perform optical character recognition (OCR) on the image of the VIN;

query a vehicle database using the VIN to retrieve one or more vehicle identifiers for the vehicle; and associate the keychain device with the one or more vehicle identifiers.

5. A system in accordance with claim 1, wherein the VKM computer device is further configured to define one or more parameters of the authorized location zone, further comprising one or more of the following: storing the current location of the keychain device as a center of the authorized location zone and defining a radius around the current location, wherein the authorized location zone is bounded by the defined radius encircling the current location; storing a sequence of current locations of the keychain device, wherein the keychain device is transported along a defined path; and defining the authorized location zone as a polygonal area bounded by lines drawn between a plurality of current locations of the keychain device.

6. A system in accordance with claim 1, wherein the VKM computer device is further configured to perform statistical analysis and reporting on the keychain device, including one or more of:

determining the historical locations of the keychain device within a defined time period in the past; and determining the number of occasions the keychain device was not in an authorized location zone.

7. A system in accordance with claim 1, wherein the location transmitter device comprises one or more of: the keychain device, a cellular phone tower computer, a global positioning satellite computer, a Bluetooth enabled device, and a wi-fi enabled device.

8. A system in accordance with claim 1, wherein the VKM computer device is further configured to:

receive a client device location and a radius value from the client computer device;

generate an area around the client device location using the client device location and the radius; and store the generated area as the authorized location zone for the keychain device.

9. A system in accordance with claim 1, wherein the VKM computer device is further configured to:

receive mapping data for a geographical region expected to store the keychain device;

receive at least one boundary identifier from the client computer device, the boundary identifier representing one or more boundaries for enclosing the authorized location zone; and define the authorized location zone using the at least one boundary identifier.

10. A system in accordance with claim 1, wherein the VKM computer device is further configured to:

receive a first timestamp and a first instruction to record a path for the keychain device from the client computer device;

store a plurality of location records for the keychain device, each of the plurality of location records representing a location of the keychain device at predetermined time intervals;

receive a second timestamp and a second instruction to cease recording the path; and define the authorized location zone using the plurality location records stored during a timeframe bounded by the first timestamp and the second timestamp.

11. A method of tracking and monitoring a physical location of keys for a vehicle using a keychain device attached to the keys, said method implemented using a vehicle key monitoring (VKM) computer device comprising a processor and a memory and configured to be coupled to a location database, said method comprising:

receiving, from a location transmitter device, a time identifier associated with the keychain device and a current location of the keychain device, including a first location identifier, wherein the location transmitter device comprises at least one of: the keychain device, a cellular phone tower computer, a global positioning satellite computer, a Bluetooth enabled device, and a wi-fi enabled device;

storing the time identifier and the current location of the keychain device in the location database;

comparing the first location identifier to an authorized location zone and the time identifier to an authorized time interval for the keychain device, wherein the authorized location zone includes one or more of a plurality of contiguous location identifiers;

transmitting the current location to a client computer device operated by a vehicle owner;

determining that the keychain device is in an unauthorized state, comprising determining one or more of the following:

that the first location identifier fails to correspond to the plurality of contiguous location identifiers; and that the time identifier fails to correspond to the authorized time interval;

generating an alert indicating that the keychain device is in the unauthorized state; and transmitting the alert to the client computer device, causing the client computer device to update a display with the alert and the current location of the keychain device.

12. A method in accordance with claim 11, further comprising associating a first client computer device identifier with the keychain device.

13. A method in accordance with claim 11, further comprising:

receiving, from the client computer device, a transfer indicator indicating that control of the vehicle has been transferred to a second vehicle owner, and a second client computer device identifier;

associating the second client computer device identifier with the vehicle in the location database; and removing the association between the first client computer device identifier and the vehicle from the location database.

14. A method in accordance with claim 11, further comprising:

receiving an image of the vehicle identification number (VIN) from the vehicle;

performing optical character recognition (OCR) on the image of the VIN;

querying a vehicle database using the VIN to retrieve one or more vehicle identifiers for the vehicle; and associating the keychain device with the one or more vehicle identifiers.

15. A method in accordance with claim 1, wherein the VKM computer device is further configured to define one or more parameters of the authorized location zone, further comprising one or more of the following: storing the current location of the keychain device as a center of the authorized location zone and defining a radius around the current location, wherein the authorized location zone is bounded by the defined radius encircling the current location; storing a sequence of current locations of the keychain device, wherein the keychain device is transported along a defined path; and defining the authorized location zone as a polygonal area bounded by lines drawn between a plurality of current locations of the keychain device.

16. A method in accordance with claim 11, wherein the VKM computer device is further configured to perform statistical analysis and reporting on the keychain device, including one or more of:

determining the historical locations of the keychain device within a defined time period in the past; and determining the number of occasions the keychain device was not in an authorized location zone.

17. A non-transitory computer readable medium that includes computer executable instructions for tracking and monitoring a physical location of keys for a vehicle using a keychain device attached to the keys, wherein when executed by a vehicle key monitoring (VKM) computer device coupled to a location database, the computer-executable instructions cause the VKM computer device to:

receive, from a location transmitter device, a time identifier associated with the keychain device and a current location of the keychain device, including a first location identifier, wherein the location transmitter device comprises at least one of: the keychain device, a cellular phone tower computer, a global positioning satellite computer, and a radio frequency identification computer;

store the time identifier and the current location of the keychain device in the location database;

compare the first location identifier to an authorized location zone and the time identifier to an authorized time interval for the keychain device, wherein the authorized location zone includes one or more of a plurality of contiguous location identifiers;

transmit the current location to a client computer device operated by a vehicle owner;

determine that the keychain device is in an unauthorized state, comprising determining one or more of the following:

that the first location identifier fails to correspond to the plurality of contiguous location identifiers; and that the time identifier fails to correspond to the authorized time interval;

generate an alert indicating that the keychain device is in the unauthorized state; and transmit the alert to the client computer device, causing the client computer device to update a display with the alert and the current location of the keychain device.

18. A non-transitory computer readable medium in accordance with claim 17, wherein the computer-executable instructions cause the VKM computer device to associate a first client computer device identifier with the keychain device;

receive, from the client computer device, a transfer indicator indicating that control of the vehicle has been transferred to a second vehicle owner, and a second client computer device identifier;

associate the second client computer device identifier with the vehicle in the location database; and remove the association between the first client computer device identifier and the vehicle from the location database.

19. A non-transitory computer readable medium in accordance with claim 17, wherein the computer-executable instructions cause the VKM computer device to:

receive an image of the vehicle identification number (VIN) from the vehicle;

perform optical character recognition (OCR) on the image of the VIN;

query a vehicle database using the VIN to retrieve one or more vehicle identifiers for the vehicle; and associate the keychain device with the one or more vehicle identifiers.

20. A non-transitory computer readable medium in accordance with claim 17, wherein the computer-executable instructions cause the VKM computer device to define one or more parameters of the authorized location zone, further comprising one or more of the following:

storing the current location of the keychain device as a center of the authorized location zone and defining a radius around the current location, wherein the authorized location zone is bounded by the defined radius encircling the current location;

storing a sequence of current locations of the keychain device, wherein the keychain device is transported along a defined path; and defining the authorized location zone as a polygonal area bounded by lines drawn between a plurality of current locations of the keychain device.

* * * * *